US008731910B2

(12) United States Patent
Wu et al.

(10) Patent No.: US 8,731,910 B2
(45) Date of Patent: May 20, 2014

(54) COMPENSATOR AND COMPENSATION METHOD FOR AUDIO FRAME LOSS IN MODIFIED DISCRETE COSINE TRANSFORM DOMAIN

(75) Inventors: Ming Wu, Nanjing (CN); Zhibin Lin, Nanjing (CN); Ke Peng, Shenzhen (CN); Zheng Deng, Nanjing (CN); Jing Lu, Nanjing (CN); Xiaojun Qiu, Nanjing (CN); Jiali Li, Shenzhen (CN); Guoming Chen, Shenzhen (CN); Hao Yuan, Shenzhen (CN); Kaiwen Liu, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 236 days.

(21) Appl. No.: 13/382,725

(22) PCT Filed: Feb. 25, 2010

(86) PCT No.: PCT/CN2010/070740

§ 371 (c)(1),
(2), (4) Date: Jan. 6, 2012

(87) PCT Pub. No.: WO2011/006369

PCT Pub. Date: Jan. 20, 2011

(65) Prior Publication Data

US 2012/0109659 A1 May 3, 2012

(30) Foreign Application Priority Data

Jul. 16, 2009 (CN) ..... 2009 1 0158577

(51) Int. Cl.

| | |
|---|---|
| ***G10L 21/00*** | (2013.01) |
| ***G10L 19/02*** | (2013.01) |
| ***G10L 19/00*** | (2013.01) |

(52) U.S. Cl.

USPC ..... 704/204; 704/203; 704/201

(58) Field of Classification Search

USPC ..... 704/200–230, 500–504

See application file for complete search history.

(56) References Cited

U.S. PATENT DOCUMENTS

| | | | | |
|---|---|---|---|---|
| 6,775,649 | B1 * | 8/2004 | DeMartin | 704/201 |
| 7,552,048 | B2 * | 6/2009 | Xu et al. | 704/206 |

(Continued)

FOREIGN PATENT DOCUMENTS

| | | | |
|---|---|---|---|
| CN | 101308660 | A | 11/2008 |
| CN | 101471073 | A | 7/2009 |

(Continued)

OTHER PUBLICATIONS

Ofir et al. "Audio Packet Loss Concealment in a Combined MDCT-MDST Domain". IEEE Signal Processing Letters, vol. 14, No. 12, pp. 1032-1035, Dec. 2007.*

International Search Report for PCT/CN2010/070740 dated May 13, 2010.

*Primary Examiner* — Jesse Pullias

(74) *Attorney, Agent, or Firm* — Ling Wu; Stephen Yang; Ling and Yang Intellectual Property

(57) ABSTRACT

The invention provides a compensation method for audio frame loss in a MDCT domain, the method comprising: when a frame currently lost is a $P^{th}$ frame, obtaining a set of frequencies to be predicted, and for each frequency in the set, using phases and amplitudes of a plurality of frames before a $(P-1)^{th}$ frame in a MDCT-MDST domain to predict a phase and an amplitude of the $P^{th}$ frame, and using the predicted phase and amplitude to obtain a MDCT coefficient of the $P^{th}$ frame at each corresponding frequency; for a frequency outside the set, using MDCT coefficients of a plurality of frames before the $P^{th}$ frame to calculate a MDCT coefficient value of the $P^{th}$ frame at the frequency; performing an IMDCT for the MDCT coefficients of the $P^{th}$ frame to obtain a time domain signal of the $P^{th}$ frame.

19 Claims, 5 Drawing Sheets

(56) References Cited

U.S. PATENT DOCUMENTS

| | | | | |
|---|---|---|---|---|
| 8,214,222 | B2 * | 7/2012 | Chon et al. | 704/500 |
| 8,255,207 | B2 * | 8/2012 | Vaillancourt et al. | 704/219 |
| 8,438,015 | B2 * | 5/2013 | Schnell et al. | 704/211 |
| 2007/0094009 | A1 * | 4/2007 | Ryu et al. | 704/200.1 |
| 2008/0033718 | A1 * | 2/2008 | Zopf et al. | 704/229 |

FOREIGN PATENT DOCUMENTS

| | | | |
|---|---|---|---|
| KR | 20070059860 | A | 6/2007 |
| WO | 2008007698 | A1 | 1/2008 |

* cited by examiner

COMPENSATOR AND COMPENSATION METHOD FOR AUDIO FRAME LOSS IN MODIFIED DISCRETE COSINE TRANSFORM DOMAIN

TECHNICAL FIELD

The present invention relates to an audio decoding field, and especially to a compensator and compensation method for audio frame loss in a MDCT (modified discrete cosine transform) domain with no time delay and low complexity.

BACKGROUND OF THE RELATED ART

Packet technology is applied very widely in network communication. Various information, such as voice, audio or other data, are transmitted in the network after being encoded using the packet technology, such as VoIP (voice over Internet Protocol) and so on. The frame information loss of voice and audio resulted from the limitation of the transmission capacity of the information transmitting end, the packet information frame not arriving at the buffer area of the receiving end in a designated delay time, or network congestion and so on causes the quality of the synthetic voice and audio at the decoding end to reduce rapidly, so it needs to use some technologies to compensate for the data of frame loss. The frame loss compensator is precisely a technology which alleviates the reduction of voice and audio quality due to the frame loss. Currently there are many technologies for the frame loss compensation, but most of these technologies are suitable for voice frame loss compensation, while few related technologies for audio frame loss compensation.

The simplest existing method for audio frame loss compensation is a method of repeating the MDCT signal of the last frame or mute replacement. Although the method is simple to implement and has no delay, the compensation effect is average. Other compensation methods, such as GAPES (gap data amplitude phase estimation technology), convert a MDCT coefficient to a DSTFT (Discrete Short-Time Fourier Transform) coefficient. But the methods are of high complexity and large expense of memory. 3GPP performs the audio frame loss compensation with a shaping noise insertion technology, and the method has a good compensation effect for a noise-like signal but a rather worse compensation effect for a multiple-harmonic audio signal.

In general, most of the disclosed audio frame loss compensation technologies have unapparent effects, or are of high calculation complexity and excessively long delay time.

SUMMARY OF THE INVENTION

The technical problem to be solved by the invention is to provide a compensator and a compensation method for audio frame loss in a MDCT domain, and the invention has a good compensation result, a low complexity and no delay.

To solve the above problem, the invention provides a compensation method for audio frame loss in a modified discrete cosine transform domain, the method comprising:

step a, when a frame currently lost is a $P^{th}$ frame, obtaining a set of frequencies to be predicted, and for each frequency in the set of frequencies to be predicted, using phases and amplitudes of a plurality of frames before $(P-1)^{th}$ frame in a MDCT-MDST (modified discrete cosine transform-modified discrete sine transform) domain to predict a phase and an amplitude of the $P^{th}$ frame in the MDCT-MDST domain, using the predicted phase and amplitude of the $P^{th}$ frame in the MDCT-MDST domain to obtain a MDCT (modified discrete cosine transform) coefficient of the $P^{th}$ frame at the each frequency, wherein, the $(P-1)^{th}$ frame is the frame before the $P^{th}$ frame;

step b, for a frequency in a frame outside the set of frequencies to be predicted, using MDCT coefficients of a plurality of frames before the $P^{th}$ frame to calculate a MDCT coefficient of the $P^{th}$ frame at the frequency;

step c, performing an IMDCT (inverse modified discrete cosine transform) for the MDCT coefficients of the $P^{th}$ frame at all frequencies to obtain a time domain signal of the $P^{th}$ frame.

The method may be further characterized in that, before the step a, the method further comprises: when detecting that a current frame is lost, judging a type of the currently lost frame, and performing the step a if the currently lost frame is a multiple-harmonic frame.

The method may be further characterized in that the step of judging a type of the currently lost frame comprises:

calculating a spectrum flatness of each frame in K frames before the currently lost frame; if a number of frames whose spectrum flatness is smaller than a threshold value is smaller than or equal to $K_0$ in the K frames, the currently lost frame being a non-multiple-harmonic frame; if the number of frames whose spectrum flatness is smaller than the threshold value is greater than $K_0$, the currently lost frame being a multiple-harmonic frame; wherein, $K_0<=K$, and $K_0$, K are natural numbers.

The method may be further characterized in that when obtaining the set of frequencies to be predicted in the step a, MDCT-MDST-domain complex signals and/or MDCT coefficients of a plurality of frames before the $P^{th}$ frame are used to obtain a set $S_C$ of frequencies to be predicted, or, all frequencies in a frame are directly placed in the set $S_C$ of frequencies to be predicted.

The method may be further characterized in that, the step of using MDCT-MDST-domain complex signals and/or MDCT coefficients of a plurality of frames before the $P^{th}$ frame to obtain the set $S_C$ of frequencies to be predicted comprises:

setting said a plurality of frames before the $P^{th}$ frame as L1 frames, calculating a power of each frequency in the L1 frames, obtaining L1 sets of $S_1, \ldots, S_{L1}$ composed of peak-value frequencies in each frame in the L1 frames, and a number of corresponding frequencies in each set being $N_1, \ldots, N_{L1}$ respectively;

selecting a set $S_i$ from the L1 sets of $S_1, \ldots, S_{L1}$, judging whether there is any frequency belonging to all other peak-value frequency sets simultaneously in $m_j, m_j\pm1, \ldots, m_j\pm k$ for each peak-value frequency $m_j$, $j=1 \ldots N_i$ in the $S_i$, if yes, putting all the $m_j, m_1\pm1, \ldots, m_j\pm k$ in the frequency set $S_C$;

if there is no frequency belonging to all other peak-value frequency sets simultaneously for each peak-value frequency $m_j$, $j=1 \ldots N_i$ in the $S_i$, putting all the frequencies in a frame in the frequency set $S_C$;

wherein, the k is a nonnegative integer.

The method may be further characterized in that the peak-value frequency refers to a frequency whose power is bigger than powers on two adjacent frequencies thereof.

The method may be further characterized in that when the L1 frames comprise the $(P-1)^{th}$ frame, the power of each frequency in the $(P-1)^{th}$ frame is calculated in the following way: $|\hat{v}^{p-1}(m)|^2=[c^{p-1}(m)]^2+[c^{p-1}(m+1)-c^{p-1}(m-1)-c^{p-1}(m-1)]^2$, wherein, $|\hat{v}^{p-1}(m)|^2$ is the power of a frequency m in the $(P-1)^{th}$ frame, $c^{p-1}(m)$ is the MDCT coefficient of the frequency m in the $(P-1)^{th}$ frame, $c^{p-1}(m+1)$ is the MDCT coefficient of the frequency m+1 in the $(P-1)^{th}$ frame, $c^{p-1}(m-1)$ is the MDCT coefficient of a frequency m−1 in the $(P-1)^{th}$ frame.

The method may be further characterized in that the step of predicting the phase and amplitude of the $P^{th}$ frame in the MDCT-MDST domain in the step a comprises: for a frequency to be predicted, using phases of L2 frames before the $(P-1)^{th}$ frame in the MDCT-MDST domain at the frequency to perform a linear extrapolation or a linear fit to obtain the phase of the $P^{th}$ frame in the MDCT-MDST domain at the frequency; obtaining the amplitude of the $P^{th}$ frame in the MDCT-MDST domain at the frequency from an amplitude of one of the L2 frames in the MDCT-MDST domain at the frequency, wherein, L2>1.

The method may be further characterized in that, when L2=2, a $t1^{th}$ frame and a $t2^{th}$ frame are used to represent the two frames respectively, and the phase of the $P^{th}$ frame in the MDCT-MDST domain is predicted in the following way: for a frequency m to be predicted, $$\hat{\varphi}^{p}(m) = \varphi^{t1}(m) + \frac{p - t1}{t1 - t2}[\varphi^{t1}(m) - \varphi^{t2}(m)],$$

wherein, the $\phi^{p}$ (m) is a predicted value of the phase of the $P^{th}$ frame in the MDCT-MDST domain at the frequency m, the $^{t1}$(m) is a phase of the $t1^{th}$ frame in the MDCT-MDST domain at the frequency m, and the $\phi^{t2}$ (m) is a phase of the $t2^{th}$ frame in the MDCT-MDST domain at the frequency m.

The method may be further characterized in that, when L2>2, for a frequency to be predicted, a linear fit is performed for phases of the L2 frames before the $(P-1)^{th}$ frame in the MDCT-MDST domain at the frequency to obtain the phase of the $P^{th}$ frame in the MDCT-MDST domain at the frequency.

The method may be further characterized in that, in the step a, the set of frequencies to be predicted is obtained by using MDCT-MDST-domain complex signals of the $(P-2)^{th}$ frame and the $(P-3)^{th}$ frame and a MDCT coefficient of the $(P-1)^{th}$ frame; and for each frequency in the frequency set $S_C$, the phase and amplitude of the $P^{th}$ frame in the MDCT-MDST domain is predicted by using phases and amplitudes of the $(P-2)^{th}$ frame and the $(P-3)^{th}$ frame in the MDCT-MDST domain.

The method may be further characterized in that, in the step b, half of a MDCT coefficient of the $(P-1)^{th}$ frame is used as the MDCT coefficient of the $P^{th}$ frame.

The invention also provides a compensator for audio frame loss in a modified discrete cosine transform domain, the compensator comprising a multiple-harmonic frame loss compensation module, a second compensation module and an IMDCT module, wherein:

the multiple-harmonic frame loss compensation module is configured to, when a frame currently lost is a $P^{th}$ frame, obtain a set of frequencies to be predicted, and for each frequency in the set of frequencies to be predicted, use phases and amplitudes of a plurality of frames before a $(P-1)^{th}$ frame in a MDCT-MDST domain to predict a phase and an amplitude of the $P^{th}$ frame in the MDCT-MDST domain, use the predicted phase and amplitude of the $P^{th}$ frame in the MDCT-MDST domain to obtain a MDCT coefficient of the $P^{th}$ frame at the each frequency, and transmit the MDCT coefficient to the second compensation module, wherein, the $(P-1)^{th}$ frame is a last frame of the $P^{th}$ frame;

the second compensation module is configured to, for a frequency outside the set of frequencies to be predicted in a frame, use MDCT coefficients of a plurality of frames before the $P^{th}$ frame to calculate a MDCT coefficient of the $P^{th}$ frame at the frequency, and transmit the MDCT coefficients of the $P^{th}$ frame at all frequencies to the IMDCT module;

the IMDCT module is configured to perform an IMDCT for the MDCT coefficients of the $P^{th}$ frame at all frequencies to get a time domain signal of the $P^{th}$ frame.

The compensator for frame loss may be further characterized in that the compensator further comprises a frame type detection module, wherein:

the frame type detection module is configured to, when detecting that a frame is lost, judge a type of the currently lost frame, and instruct the multiple-harmonic frame loss compensation module to make compensation if the currently lost frame is a multiple-harmonic frame.

The compensator for frame loss may be further characterized in that the frame type detection module is configured to judge the type of the currently lost frame in the following way: a spectrum flatness of each frame in K frames before the currently lost frame is calculated; if a number of frames whose spectrum flatness is smaller than a threshold value is smaller than $K_0$ in the K frames, the currently lost frame is a non-multiple-harmonic frame; if the number of frames whose spectrum flatness is smaller than the threshold value is greater than $K_0$, the currently lost frame is a multiple-harmonic frame; wherein, $K_0$<=K, and $K_0$, K are natural numbers.

The compensator for a frame loss may be further characterized in that, the multiple-harmonic frame loss compensation module comprises a frequency set generation unit, and the multiple-harmonic frame loss compensation module is configured to, through the frequency set generation unit, use MDCT-MDST-domain complex signals and/or MDCT coefficients of a plurality of frames before the $P^{th}$ frame to obtain a set $S_C$ of frequencies to be predicted, or, put directly all frequencies in a frame in the set $S_C$ of frequencies to be predicted.

The compensator for a frame loss may be further characterized in that, the frequency set generation unit is configured to use MDCT-MDST-domain complex signals and/or MDCT coefficients of a plurality of frames before the $P^{th}$ frame to obtain the set $S_C$ of frequencies to be predicted in the following way:

setting a plurality of frames before the $P^{th}$ frame as L1 frames, calculating a power of each frequency in the L1 frames, obtaining L1 sets of $S_1, \ldots, S_{L1}$ composed of peak-value frequencies in each frame in the L1 frames, and a number of corresponding frequencies in each set being $N_1, \ldots, N_{L1}$ respectively;

selecting a set $S_i$ from the L1 sets of $S_1, \ldots, S_{L1}$, judging whether there is any frequency belonging to all other peak-value frequency sets simultaneously in $m_j, m_j\pm1, \ldots, m_j\pm k$ for each peak-value frequency $m_j$, j=1 . . . $N_i$ in the $S_i$; if yes, putting all the $m_j, m_j\pm1, \ldots, m_j\pm k$ in the frequency set $S_C$;

if there is no frequency belonging to all other peak-value frequency sets simultaneously, putting all the frequencies in a frame in the frequency set $S_C$; wherein, the k is a nonnegative integer.

The compensator for frame loss may be further characterized in that the peak-value frequency refers to a frequency whose power is bigger than powers on two adjacent frequencies thereof.

The compensator for frame loss may be further characterized in that the frequency set generation unit is configured to, when the L1 frames comprise the $(P-1)^{th}$ frame, to calculate the power of each frequency in the $(P-1)^{th}$ frame in the following way: $|\hat{v}^{p-1}(m)|^2=[c^{p-1}(m)]^2+[c^{p-1}(m+1)-c^{p-1}(m-1)]^2$, wherein, $|\hat{v}^{p-1}(m)|^2$ is the power of the frequency m in the $(P-1)^{th}$ frame, $c^{p-1}(m)$ is the MDCT coefficient of the frequency m in the $(P-1)^{th}$ frame, $c^{p-1}$ (m+1) is the MDCT coefficient of the frequency m+1 in the $(P-1)^{th}$ frame, $c^{p-1}(m-1)$ is the MDCT coefficient of the frequency m−1 in the $(P-1)^{th}$ frame.

The compensator for frame loss may be further characterized in that, the multiple-harmonic frame loss compensation module further comprises a coefficient generation unit, and the multiple-harmonic frame loss compensation module is configured to, through the coefficient generation unit, to use phases and amplitudes of the L2 frames before the $(P-1)^{th}$ frame in the MDCT-MDST domain to predict a phase and an amplitude of each frequency belonging to the set of frequencies to be predicted in the $P^{th}$ frame, use the predicted phase and amplitude of the $P^{th}$ frame to obtain the MDCT coefficient of the $P^{th}$ frame corresponding to the each frequency, and transmit the MDCT coefficient to the second compensation module, wherein, L2>1;

the coefficient generation unit comprises a phase prediction sub-unit and an amplitude prediction sub-unit, wherein:

the phase prediction sub-unit is configured to, for a frequency to be predicted, use phases of L2 frames in the MDCT-MDST domain at the frequency to perform a linear extrapolation or a linear fit to obtain the phase of the $P^{th}$ frame in the MDCT-MDST domain at the frequency;

the amplitude prediction sub-unit is configured to obtain the amplitude of the $P^{th}$ frame in the MDCT-MDST domain at the frequency from an amplitude of one of the L2 frames in the MDCT-MDST domain at the frequency.

The compensator for frame loss may be further characterized in that the phase prediction sub-unit is configured to, when L2=2, predict the phase of the $P^{th}$ frame in the MDCT-MDST domain in following way: for a frequency m to be predicted, $$\hat{\varphi}^{p}(m) = \varphi^{t1}(m) + \frac{p - t1}{t1 - t2}[\varphi^{t1}(m) - \varphi^{t2}(m)],$$

wherein, a $t1^{th}$ frame and a $t2^{th}$ frame represent two frames before the $(P-1)^{th}$ frame respectively, the $\hat{\phi}^{p}(m)$ is a predicted value of the phase of the $P^{th}$ frame in the MDCT-MDST domain at the frequency m, the $\phi^{t1}(m)$ is a phase of the $t1^{th}$ frame in the MDCT-MDST domain at the frequency m, the $\phi^{t2}(m)$ is a phase of the $t2^{th}$ frame in the MDCT-MDST domain at the frequency m.

The compensator for a frame loss may be further characterized in that the phase prediction sub-unit is configured to, when L2>2, predict the phase of the $P^{th}$ frame in the MDCT-MDST domain in the following way: for a frequency to be predicted, performing a linear fit for phases of the selected L2 frames in the MDCT-MDST domain at the frequency to obtain the phase of the $P^{th}$ frame in the MDCT-MDST domain at the frequency.

The compensator for frame loss may be further characterized in that the multiple-harmonic frame loss compensation module is configured to use MDCT-MDST-domain complex signals of the $(P-2)^{th}$ frame and the $(P-3)^{th}$ frame and a MDCT coefficient of the $(P-1)^{th}$ frame to obtain the set of frequencies to be predicted, and use phases and amplitudes of the $(P-2)^{th}$ frame and the $(P-3)^{th}$ frame in the MDCT-MDST domain to predict the phase and amplitude of the $P^{th}$ frame in the MDCT-MDST domain for each frequency in the frequency set.

The compensator for frame loss may be further characterized in that the second compensation module is configured to use half of a MDCT coefficient value of the $(P-1)^{th}$ frame as the MDCT coefficient value of the $P^{th}$ frame at a frequency outside the set of frequencies to be predicted.

Through the compensator and compensation method for audio frame loss in a MDCT domain proposed in the invention, for a non-multiple-harmonic, the MDCT coefficient of the currently lost frame is obtained by using the MDCT coefficient values of a plurality of frames before the currently lost frame through calculation; and for a multiple-harmonic, the MDCT coefficient of the currently lost frame is obtained by the characteristic of the currently lost frame in the MDCT-MDST domain. Compared with the prior art the invention has the advantages of no delay, small amount of calculation and small volume of memory space, easy implementation and so on.

PREFERRED EMBODIMENTS OF THE PRESENT INVENTION

The main idea of the invention is as follows: the MDCT-MDST domain phase and amplitude of the currently lost frame are predicted by taking advantage of the characteristic that the phase of a harmonic signal is linear in a MDCT-MDST domain and using the information of a plurality of fames before the currently lost frame, thereby obtaining the MDCT coefficient of the currently lost frame, according to which, the time domain signal of the currently lost frame is further obtained.

Figure 2:
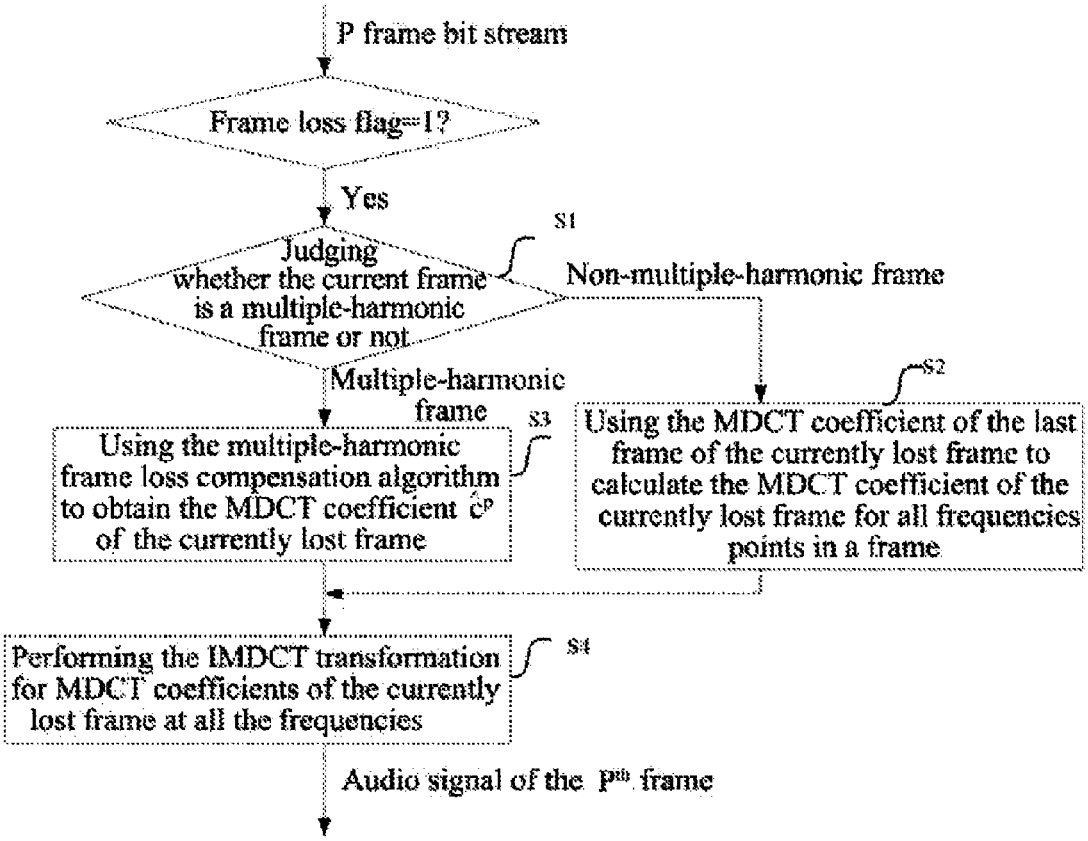
FIG. 2 is a flowchart of the compensation method for audio frame loss in a MDCT domain in the invention.
Figure 3:
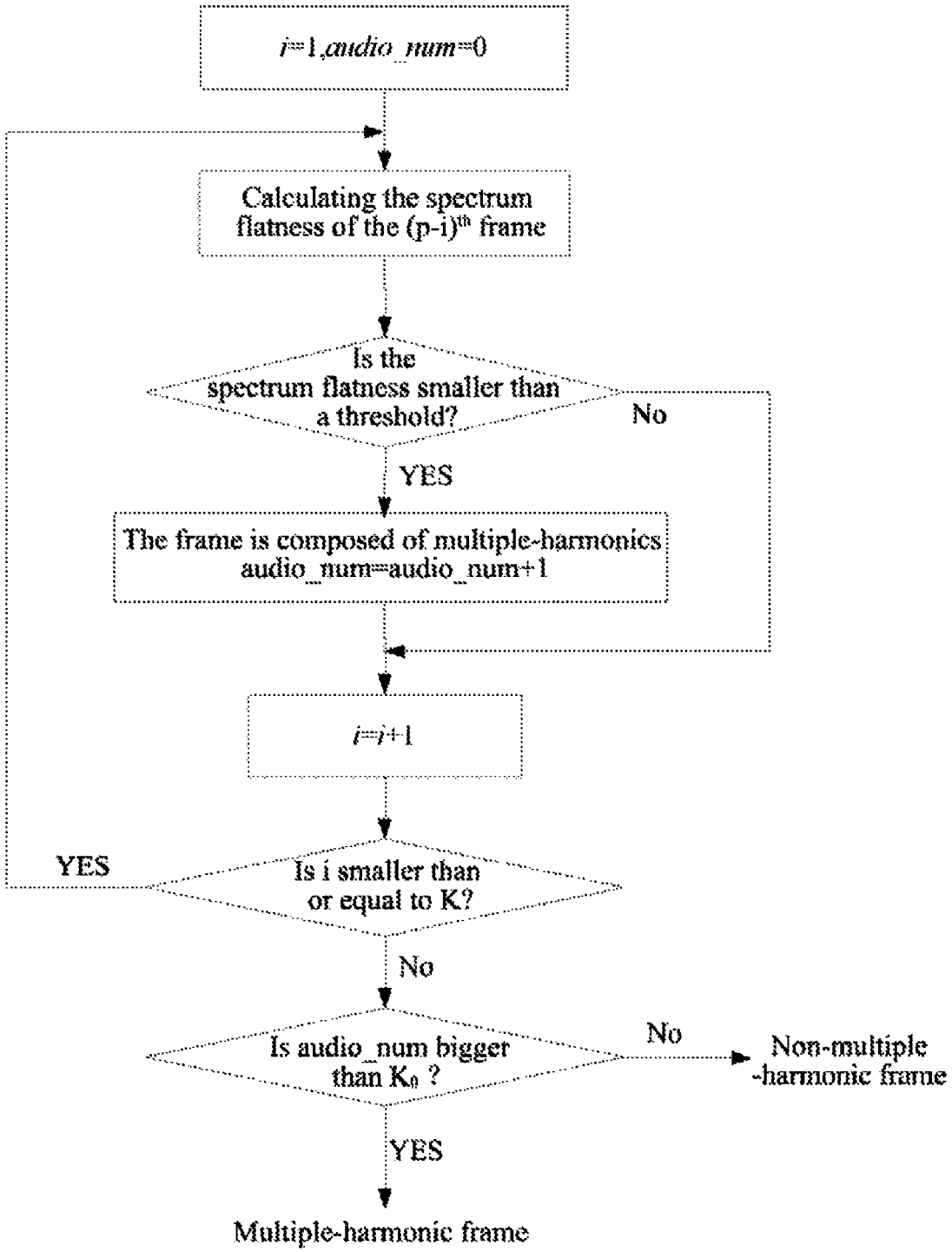
FIG. 3 is a flowchart for judging the multiple-harmonic frame/non-multiple-harmonic frame in the invention.

The invention provides a compensation method for audio frame loss in a MDCT domain, as shown in FIG. 2, the method comprising:

step S1, when detecting that the data packet of the current frame is lost, a decoding end, calling the current frame as the currently lost frame, judging the type of the currently lost frame, and proceeding to step S2 if the currently lost frame is a non-multiple-harmonic frame; or else, proceeding to step S3;

wherein, the operation of judging the type of the currently lost frame is to make judgment according to the MDCT coefficients of K frames before the currently lost frame, as shown in FIG. 3, comprising:

1a) calculating the spectrum flatness of each frame of the K frames before the currently lost frame, and considering that the frame is mainly composed of multiple-harmonics and is a multiple-harmonic steady state signal frame if the spectrum flatness is smaller than a preset threshold;

1b) if the number of multiple-harmonic steady state signal frames in the K frames is smaller than or equal to $K_0$ frames, considering that the currently lost frame is a non-multiple-harmonic, or else the currently lost frame is a multiple-harmonic (such as a music frame), wherein, $K_0$<=K, $K_0$ and K are preset values.

The invention is not limited to use the method shown in FIG. 3 to judge the type of the currently lost frame, and other methods may also be used to make judgment, for example, zero-pass ratio is used to make judgment, and the invention is not limited thereto.

step S2, if it is judged the currently lost frame is a non-multiple-harmonic frame, using the MDCT coefficient values of a plurality of frames before the currently lost frame to calculate the MDCT coefficient value of the currently lost frame for every frequency in the frame; then proceeding to step S4.

Figure 4:
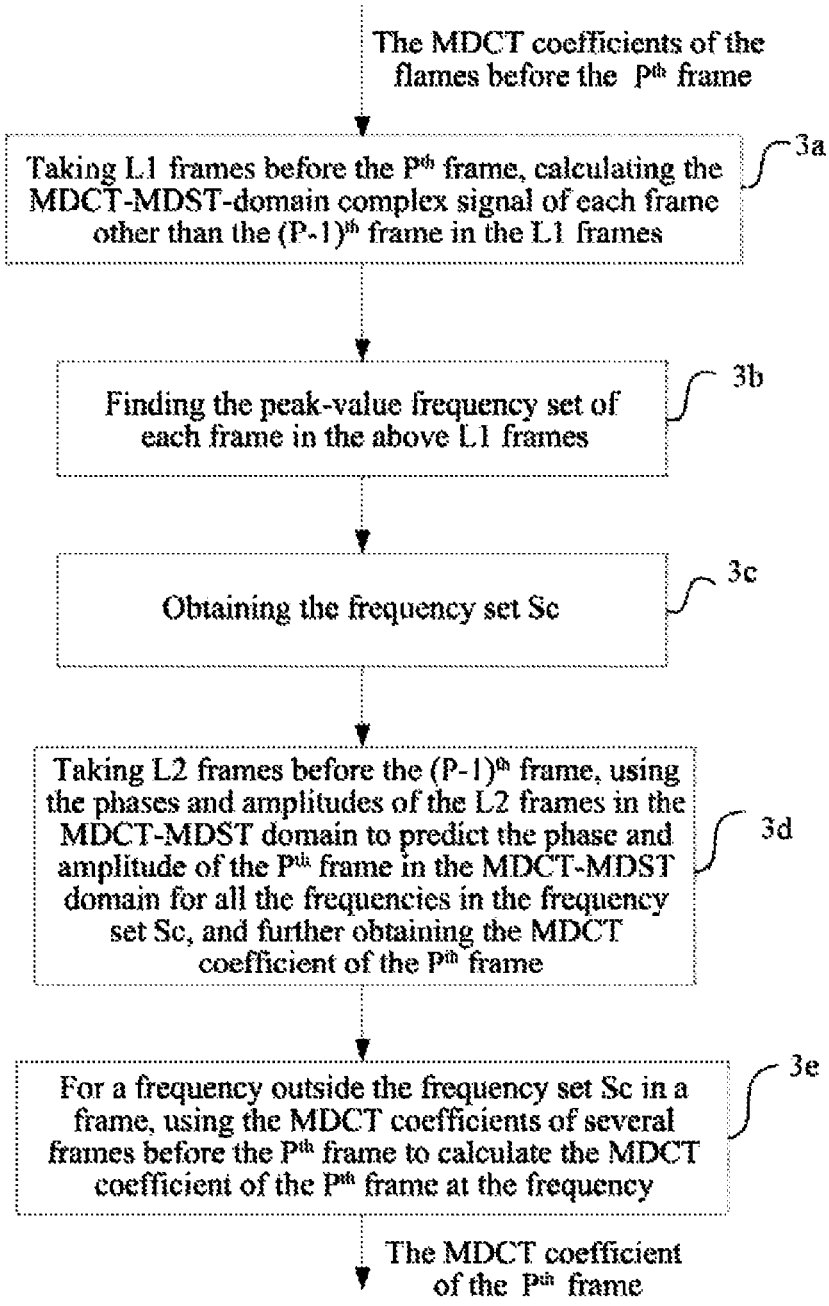
FIG. 4 is a flowchart of the compensation method for the frame loss for the multiple-harmonic frame in the invention.

For example, half of or other ratios of the MDCT coefficient value of the last frame of the currently lost frame is used as the MDCT coefficient value of the currently lost frame.

step S3, if it is judged the currently lost frame is a multiple-harmonic frame, getting through estimation the MDCT coefficient value of the currently lost frame by using the no delay multiple-harmonic frame loss compensation algorithm, as shown in FIG. 4, which specifically comprises:

3a) when the $P^{th}$ frame is lost, i.e. the currently lost frame is the $P^{th}$ frame, taking L1 frames before the $P^{th}$ frame.

When the L1 frames comprise the $(P-1)^{th}$ frame, FMDST (Fast Modified Discrete Sine Transform) algorithm is used to obtain the MDST (Modified Discrete Sine Transform) coefficients of L1−1 frames in the L1 frames except the $(P-1)^{th}$ frame according to the MDCT coefficients obtained through decoding of the frames before the currently lost frame. For the each frame in the L1−1 frames, the MDCT-MDST-domain complex signal of each frame is composed of the MDST coefficient and the MDCT coefficient of the frame, wherein, the MDCT coefficient is the real part parameter, and the MDST coefficient is the imaginary part parameter.

When the L1 frames do not comprise the $(P-1)^{th}$ frame, the FMDST algorithm is used to obtain the MDST coefficients of the L1 frames according to the MDCT coefficients obtained through the decoding of the frames before the currently lost frame. For the each frame in the L1 frames, the MDCT-MDST-domain complex signal of each frame is composed of the MDST coefficient and the MDCT coefficient of the frame, wherein, the MDCT coefficient is the real part parameter, and the MDST coefficient is the imaginary part parameter.

Wherein, the method for calculating the MDST coefficient is as follows:

an inverse MDCT transformation is performed to obtain the time domain signal of the $(P-2)^{th}$ frame according to the MDCT coefficients of the $(P-1)^{th}$ frame and the $(P-2)^{th}$ frame, and an inverse MDCT transformation is performed to obtain the time domain signal of the $(P-3)^{th}$ frame according to the MDCT coefficients of the $(P-2)^{th}$ frame and the $(P-3)^{th}$ frame, and so forth;

the FMDST algorithm is used to obtain the MDST coefficient of the $(P-2)^{th}$ frame according to the time domain signals of the $(P-2)^{th}$ frame and the $(P-3)^{th}$ frame, and the FMDST algorithm is used to obtain the MDST coefficient of the $(P-3)^{th}$ frame according to the time domain signals of the $(P-3)^{th}$ frame and the $(P-4)^{th}$ frame, and so forth.

Figure 1:
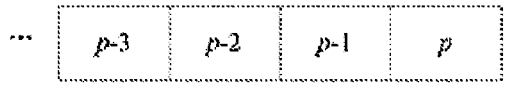
FIG. 1 is a diagram of the sequence of frames in the invention.

Wherein, the sequence of the $P^{th}$ frame, the $(P-1)^{th}$ frame and other frames are as shown in FIG. 1.

3b) finding the set of peak-value frequencies for each frame in the above L1 frames.

If the L1 frames comprise the $(P-1)^{th}$ frame, then:

for the $(P-1)^{th}$ frame, the power of each frequency in the $(P-1)^{th}$ frame is calculated according to the MDCT coefficient of the $(P-1)^{th}$ frame, and the set composed of a plurality of preceding frequencies having the biggest power is obtained;

for each frame other than the $(P-1)^{th}$ frame, the power of each frequency in the frame is calculated according to the MDCT-MDST-domain complex signal of the frame, and the set composed of a plurality of preceding frequencies having the biggest power is obtained; wherein, the peak-value frequency refers to the frequency whose power is bigger than the powers on the two adjacent frequencies thereof.

If the L1 frames do not comprise the $(P-1)^{th}$ frame, then:

for each frame in the L1 frames, the set composed of a plurality of preceding frequencies having the biggest powers is obtained according to the MDCT-MDST-domain complex signal of the frame, the number of frequencies in the L1 sets may be the same or different.

The L1 sets may be also obtained by other methods, for example, the set composed of peak-value frequencies whose powers are greater than a set threshold is taken for each frame, and the threshold for each frame may be the same or different.

3c) if L1>1, assuming that the L1 frequency sets are named as $S_1, \ldots, S_{L1}$, and the number of the corresponding frequencies in the sets are $N_1, \ldots, N_{L1}$, selecting a set $S_i$, and judging, for each peak-value frequency $m_j$ (j=1 . . . $N_i$) in the $S_i$, whether any frequency among $m_j$, $m_j \pm 1, \ldots, m_j \pm K$ (K is a nonnegative integer, which is commonly to be K=0 or 1) belongs simultaneously to all the other peak-value frequency sets, if yes, putting all the $m_j$, $m_j \pm 1, \ldots, m_j \pm K$ in the frequency set $S_C$.

If there is no frequency among the $m_j$, $m_j \pm 1, \ldots, m_j \pm K$, for each peak-value frequency $m_j$ (j=1 . . . $N_i$) in the $S_i$, belonging simultaneously to all the other peak-value frequency sets, all the frequencies in the frame are directly put in the frequency set $S_C$.

If L1=1, it is assumed that the frequency set is named as $S_1$, and the corresponding number of frequencies is $N_1$, for each peak-value frequency $m_i$ (i=1 . . . $N_1$) in the peak-value frequency set $S_1$, all the $m_i$, $m_i \pm 1, \ldots, m_i \pm K$ (K is a nonnegative integer, which is commonly selected as K=0 or 1) are put in the frequency set $S_C$.

The above sections of steps 3a, 3b and 3c may also not be performed, and all the frequencies in a frame are directly put in the frequency set $S_C$.

3d) taking L2 (L2>1) frames before the $(P-1)^{th}$ frame, calculating and obtaining the MDCT-MDST-domain complex signals of the L2 frames (the specific calculation method is the same with the method in the step 3a). For each frequency in the frequency set $S_C$, the phase of the currently lost frame in the MDCT-MDST domain is obtained by using the phases of the L2 frames in the MDCT-MDST domain, and the amplitude of the currently lost frame in the MDCT-MDST domain is obtained by using the amplitudes of the L2 frames in the MDCT-MDST domain, and then the MDCT coefficient of the currently lost frame corresponding to each frequency is obtained according to the phase and amplitude of the currently lost frame.

If L2=2, for all the frequencies in the frequency set $S_C$, the phases of the two selected frames at each frequency to be predicted are used to perform linear extrapolation to obtain the phase of the MDCT-MDST-domain complex signal of the currently lost frame at the frequency; the amplitude of the MDCT-MDST-domain complex signal of the currently lost frame at the frequency is obtained from the MDCT-MDST domain amplitude of one of the two frames at the frequency, i.e. the MDCT-MDST domain amplitude of one of the two frames at the frequency is used as the MDCT-MDST domain amplitude of the currently lost frame at the frequency.

One method for the linear extrapolation is as follows:

when L2=2, the $t1^{th}$ frame and the $t2^{th}$ frame are used to represent the two frames respectively, the phase of the MDCT-MDST domain of the $P^{th}$ frame is predicted in the following way: for the frequency m to be predicted, $$\hat{\varphi}^{p}(m) = \varphi^{t1}(m) + \frac{p - t1}{t1 - t2}[\varphi^{t1}(m) - \varphi^{t2}(m)],$$

the $\hat{\phi}^{p}(m)$ is the predicted value of the phase of the $P^{th}$ frame in the MDCT-MDST domain at the frequency m, the $\phi^{t1}(m)$ is the phase of the $t1^{th}$ frame in the MDCT-MDST domain at the frequency m, and the $\phi^{t2}(m)$ is the phase of the $t2^{th}$ frame in the MDCT-MDST domain at the frequency m.

If L2>2, for all the frequencies in the set $S_C$, the MDCT-MDST domain phases of the L2 frames at each frequency to be predicted are used to perform linear fit to get the phase of the MDCT-MDST-domain complex signal of the currently lost frame at the frequency; the amplitude of the MDCT-MDST-domain complex signal of the currently lost frame at the frequency is obtained from the MDCT-MDST domain amplitude of one of the two frames at the frequency, i.e. the MDCT-MDST domain amplitude of one of the two frames at the frequency is used as the MDCT-MDST domain amplitude of the currently lost frame at the frequency.

3e) for a frequency outside the frequency set $S_C$, calculating the MDCT coefficient value of the $P^{th}$ frame using the MDCT coefficient values of a plurality of frames before the $P^{th}$ frame. For example, half of the MDCT coefficient value of the last frame of the currently lost frame is used as the MDCT coefficient value of the currently lost frame.

In another example of the invention, in step S3 or before the step 3a, the step "using the MDCT coefficient values of a plurality of frames before the currently lost frame to calculate the MDCT coefficient value of the currently lost frame for every frequency in the frame" is performed, and then steps 3a, 3b, 3c and 3d are performed, and then step 3e is skipped to enter the step S4.

Other variations may be performed, for example, step 3e may be performed after the step 3c and before the step S4, i.e. may be performed just after the frequency set $S_C$ is obtained.

Step S4, performing an IMDCT (inverse MDCT) transformation for the MDCT coefficients of the currently lost frame at all the frequencies to obtain the time domain signal of the currently lost frame.

The above example may have the following variations: firstly, the initial compensation is performed, i.e. the MDCT coefficient value of the $P^{th}$ frame is calculated by using the MDCT coefficient values of a plurality of frames before the $P^{th}$ frame, and then the type of the currently lost frame is judged, and different steps are performed according to the type of the currently lost frame; the step S4 is directly performed if the frame is a non-multiple-harmonic frame, and if the frame is a multiple-harmonic frame, steps 3a, 3b, 3c and 3d in the step S3 are performed and then the step 3e is skipped to perform the step S4 directly.

The invention will be further illustrated below with reference to two specific examples.

EXAMPLE 1

Step 110, a decoding end judges whether the current frame (i.e. currently lost frame) is a multiple-harmonic frame (for example, a music frame composed of various harmonics) or not when detecting data packet loss of the current frame, and performs step 120 if the current frame is a non-multiple-harmonic frame, or else, performs the step 130.

The specific judging method is:

calculating the spectrum flatness of 10 frames before the currently lost frame, and considering the frame to be a multiple-harmonic steady state signal frame when the spectrum flatness is smaller than 0.1; if more than 8 frames in the 10 frames before the lost frame are multiple-harmonic steady state signal frames, considering the currently lost frame to be a multiple-harmonic frame, or considering the currently lost frame to be a non-multiple-harmonic frame. The method for calculating the spectrum flatness is as follows:

the spectrum flatness of the $i^{th}$ frame $SFM_i$ is defined as the ratio of the geometric mean to the algorithm mean of the amplitude of the transformation domain signal of the $i^{th}$ frame signal:

$$SFM_i = \frac{G_i}{A_i} \tag{1}$$

wherein, $$G_i = \left(\prod_{m=0}^{M-1} |c^i(m)|\right)^{\frac{1}{M}}$$

is the geometric mean of the amplitude of the $i^{th}$ frame signal, $$A_i = \frac{1}{M}\sum_{m=0}^{M-1} |c^i(m)|$$

is the algorithm mean of the amplitude of the $i^{th}$ frame signal, $c^i(m)$ is the MDCT coefficient of the $i^{th}$ frame at the frequency m, and M is the length of the MDCT domain signal frame.

Step 120, if the currently lost frame is judged to be a non-multiple-harmonic frame, half of the MDCT coefficient value of the last frame of the currently lost frame is used as the MDCT coefficient value of the currently lost frame for every frequency in the frame, i.e.

$$c^{p}(m)=0.5*c^{p-1}(m)\ m=0,1,2,3\ldots M-1 \tag{2}$$

then step 140 is performed.

Step 130, if the currently lost frame is judged to be a multiple-harmonic frame, the MDCT coefficient of the currently lost frame is obtained by using the no delay multiple-harmonic frame loss compensation algorithm, and the step 140 is performed.

Figure 5:
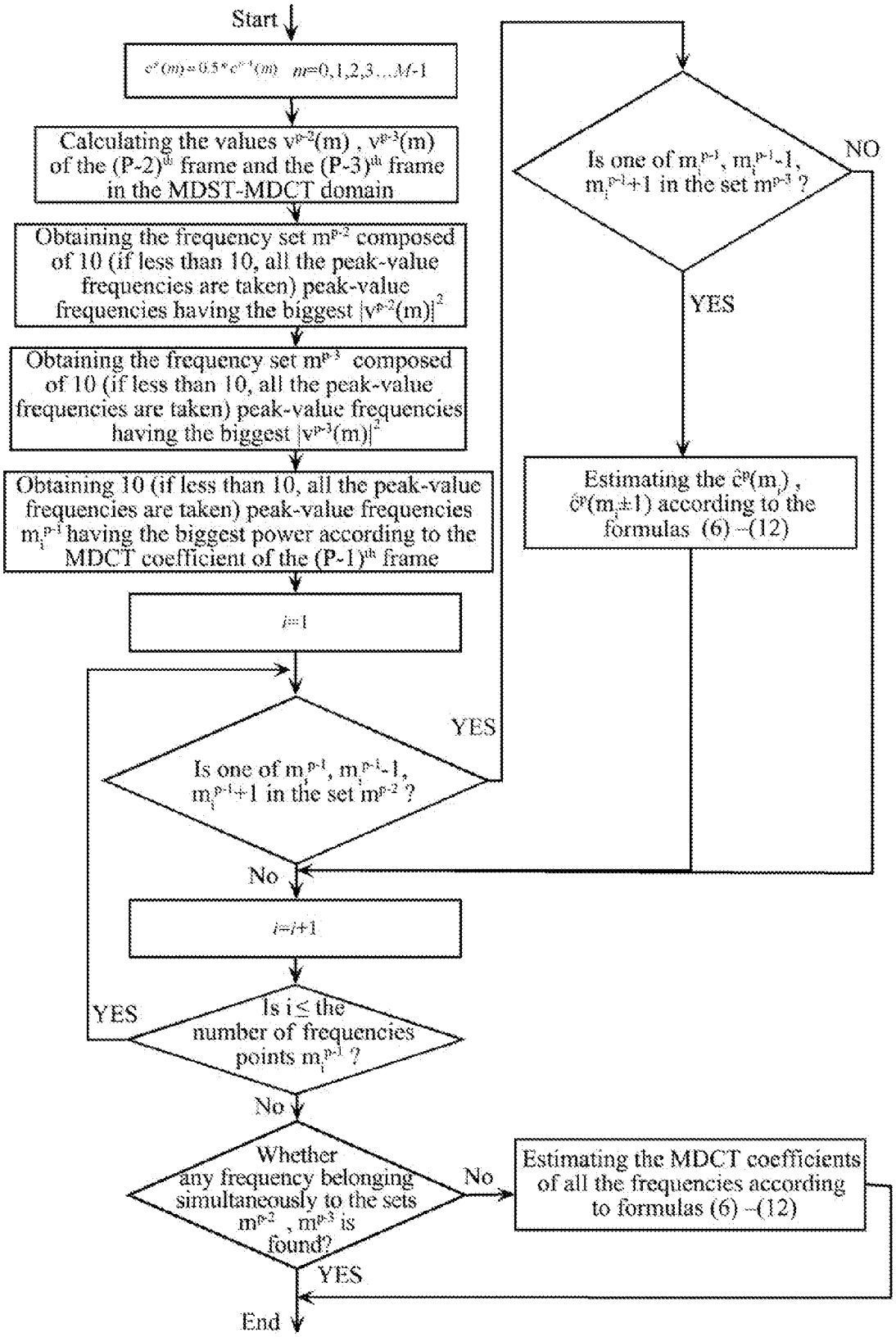
FIG. 5 is a flowchart of the method for calculating the MDCT coefficient for the frame loss compensation of a multiple-harmonic frame in the Example 1 of the invention.

The specific method for using the no delay multiple-harmonic frame loss compensation algorithm to obtain the MDCT coefficient of the currently lost frame is as shown in FIG. 5, comprising: when the data packet of the $P^{th}$ frame is lost, firstly, using half of the MDCT coefficient value of the $(P-1)^{th}$ frame at the frequency as the MDCT coefficient value of the $P^{th}$ frame at the frequency for all the frequencies in a frame, as shown in formula (2);

then, using FMDST algorithm to obtain the MDST coefficients $s^{p-2}(m)$ and $s^{p-3}(m)$ of the $(P-2)^{th}$ frame and the $(P-3)^{th}$ frame according to the MDCT coefficients, which are obtained through decoding, of the frames before the currently lost frame. The obtained MDST coefficients of the $(P-2)^{th}$ frame and the $(P-3)^{th}$ frame and the MDCT coefficients of the $(P-2)^{th}$ frame and the $(P-3)^{th}$ frame $c^{p-2}(m)$ and $c^{p-3}(m)$ compose the complex number signals in the MDCT-MDST domain:

$$v^{p-2}(m)=c^{p-2}(m)+js^{p-2}(m) \tag{3}$$

$$v^{p-3}(m)=c^{p-3}(m)+js^{p-3}(m) \tag{4}$$

wherein, j is an imaginary number symbol;

calculating the power of each frequency in the $(P-2)^{th}$ frame and the $(P-3)^{th}$ frame $|v^{p-2}(m)|^2, |v^{p-3}(m)|^2$, composing the frequency sets $m^{p-2}$, $m^{p-3}$ by taking the first 10 peak-value frequencies having the biggest power respectively in the $(P-2)^{th}$ frame and the $(P-3)^{th}$ frame (if the number of the peak-value frequencies in any frame is less than 10, all the peak-value frequencies in the frame are taken);

estimating the power of each frequency in the $(P-1)^{th}$ frame according to the MDCT coefficient of the $(P-1)^{th}$ frame.

$$|\hat{v}^{p-1}(m)|^2=[c^{p-1}(m)]^2+[c^{p-1}(m+1)-c^{p-1}(m-1)]^2 \tag{5}$$

wherein, $|\hat{v}^{p-1}(m)|^2$ is the power of the $(P-1)^{th}$ frame at the frequency m, $c^{p-1}(m)$ is the MDCT coefficient of the $(P-1)^{th}$ frame at the frequency m, the rest is similar;

obtaining through calculation the first 10 peak-value frequencies having the biggest power in the $(P-1)^{th}$ frame $m_i^{p-1}$, i=1 . . . 10, wherein if the number of the peak-value frequencies in any frame is less than 10, all the peak-value frequencies in the frame $m_i^{p-1}$, i=1 . . . $N^{p-1}$, are taken;

for each $m_i^{p-1}$, judging whether any of $m_i^{p-1}$, $m_i^{p-1}\pm1$ (frequencies near the peak-value frequency are added to the peak-value frequency set of the $(P-1)^{th}$ frame, because their power may be also very big) belongs to the sets $m^{p-2}$, $m^{p-3}$ simultaneously, if yes, obtaining the phase and amplitude of the MDCT-MDST-domain complex signal of the $P^{th}$ frame at frequencies $m_i^{p-1}$, $m_i^{p-1}\pm1$ (the following calculation is made for all the three frequencies $m_i^{p-1}$, $m_i^{p-1}\pm1$ as long as one of the $m_i^{p-1}$, $m_i^{p-1}\pm1$ belongs to $m^{p-2}$, $m^{p-3}$ simultaneously) according to the following formulas (6)-(11):

$$\phi^{p-2}(m)=\angle v^{p-2}(m) \tag{6}$$

$$\phi^{p-3}(m)=\angle v^{p-3}(m) \tag{7}$$

$$A^{p-2}(m)=|v^{p-2}(m)| \tag{8}$$

$$A^{p-3}(m)=|v^{p-3}(m)| \tag{9}$$

$$\hat{\phi}^{p}(m)=\phi^{p-2}(m)+2[\phi^{p-2}(m)-\phi^{p-3}(m)] \tag{10}$$

$$\hat{A}^{p}(m)=A^{p-2}(m) \tag{11}$$

wherein, $\phi$, A represent phase and amplitude respectively. For example, $\hat{\phi}^{p}(m)$ is the phase of the $P^{th}$ frame at the frequency m, $\hat{\phi}^{p-2}(m)$ is the phase of the $(P-2)^{th}$ frame at the frequency m, $\hat{\phi}^{p-3}(m)$ is the phase of the $(P-3)^{th}$ frame at the frequency m, $\hat{A}^{p}(m)$ is the amplitude of the $P^{th}$ frame at the frequency m, and $\hat{A}^{p-2}(m)$ is the amplitude of the $(P-2)^{th}$ frame at the frequency m, the rest is similar;

accordingly, the MDCT coefficient of the $P^{th}$ frame at the frequency m obtained through compensation is $$\hat{c}^{p}(m)=\hat{A}^{p}(m)\cos[\hat{\phi}^{p}(m)] \tag{12}$$

if no frequency in all the $m_i^{p-1}$, $m_i^{p-1}\pm1$ belongs to the sets $m^{p-2}$, $m^{p-3}$ simultaneously, estimating the MDCT coefficients for all the frequencies in the currently lost frame according to the formulas (6) to (12).

The operation of calculating the frequencies to be predicted may also not be performed, and MDCT coefficients are directly estimated according to the formulas (6) to (12) for all the frequencies in the currently lost frame.

Step 140, IMDCT transformation is performed for the MDCT coefficients of the currently lost frame at all the frequencies to obtain the time domain signal of the currently lost frame.

EXAMPLE 2

Step 210, a decoding end judges whether the current frame (i.e. currently lost frame) is a multiple-harmonic frame (for example, a music frame composed of various harmonics) or not when detecting data packet loss of the current frame, and performs step 220 if the current frame is a non-multiple-harmonic frame, or else, performs the step 230.

The specific method for judging whether the currently lost frame is a multiple-harmonic frame or not is:

calculating the spectrum flatness of 10 frames before the currently lost frame, and for each frame, considering the frame to be a multiple-harmonic steady state signal frame when the spectrum flatness is smaller than 0.1; if more than 8 frames in the 10 frames before the lost frame are multiple-harmonic steady state signal frames, considering the currently lost frame to be a multiple-harmonic frame, otherwise considering the currently lost frame to be a non-multiple-harmonic frame. Wherein, the calculating method of the spectrum flatness is as follows:

the spectrum flatness of the $i^{th}$ frame $SFM_i$ is defined as the ratio of the geometric mean to the algorithm mean of the amplitude of the transformation domain signal of the $i^{th}$ frame signal:

$$SFM_i=\frac{G_i}{A_i} \tag{13}$$

wherein, $$G_i=\left(\prod_{m=0}^{M-1}|c^i(m)|\right)^{\frac{1}{M}}$$

is the geometric mean of the amplitude of the $i^{th}$ frame signal, $$A_i=\frac{1}{M}\sum_{m=0}^{M-1}|c^i(m)|$$

is the algorithm mean of the amplitude of the $i^{th}$ frame signal, $c^i(m)$ is the MDCT coefficient of the $i^{th}$ frame at the frequency m, and M is the length of the MDCT domain signal frame.

Step 220, if the currently lost frame is judged to be a non-multiple-harmonic frame, half of the MDCT coefficient value of the last frame of the currently lost frame is used as the MDCT coefficient value of the currently lost frame for every frequency in the frame, i.e.

$$c^{p}(m)=0.5*c^{p-1}(m)m=0,1,2,3\ldots M-1 \tag{14}$$

then step 240 is performed.

Step 230, if the currently lost frame is judged to be a multiple-harmonic frame, the MDCT coefficient of the currently lost frame is obtained by using the no delay multiple-harmonic frame loss compensation algorithm, and the step 240 is performed.

The specific method for using the no delay multiple-harmonic frame loss compensation algorithm to obtain the MDCT coefficient of the currently lost frame is: when the data packet of the $P^{th}$ frame is lost, using FMDST algorithm to obtain the MDST coefficients $s^{p-2}(m)$, $s^{p-3}(m)$ and $s^{p-4}(m)$ of the $(P-2)^{th}$ frame, the $(P-3)^{th}$ frame, and the $(P-4)^{th}$ frame according to the MDCT coefficients, which are obtained through decoding, of the frames before the currently lost frame. The obtained MDST coefficients of the $(P-2)^{th}$ frame, the $(P-3)^{th}$ frame, and the $(P-4)^{th}$ frame and the MDCT coefficients of the $(P-2)^{th}$ frame, the $(P-3)^{th}$ frame, and the $(P-4)^{th}$ frame $c^{p-2}(m)$, $c^{p-3}(m)$ and $c^{p-4}(m)$ compose the complex number signals in the MDCT-MDST domain:

$$v^{p-2}(m)=c^{p-2}(m)+js^{p-2}(m) \tag{15}$$

$$v^{p-3}(m)=c^{p-3}(m)+js^{p-3}(m) \tag{16}$$

$$v^{p-4}(m)=c^{p-4}(m)+js^{p-4}(m) \tag{17}$$

wherein, j is an imaginary number symbol.

calculating the power of each frequency in the $(P-2)^{th}$ frame, the $(P-3)^{th}$ frame and the $(P-4)^{th}$ frame $|v^{p-2}(m)|^2$, $|v^{p-3}(m)|^2$, $|v^{p-4}(m)|^2$, composing the frequency sets $m^{p-2}$, $m^{p-3}$, $m^{p-4}$ taking the first 10 peak-value frequencies having the biggest power respectively in the $(P-2)^{th}$ frame, the $(P-3)^{th}$ frame and the $(P-4)^{th}$ frame (if the number of the peak-value frequencies in any frame is less than 10, all the peak-value frequencies in the frame are taken);

for each frequency $m_i^{p-4}$ in the frequency set $m^{p-4}$, judging whether any of $m_i^{p-4}$, $m_i^{p-4}\pm1$ (frequencies near the peak-value frequency are added to the peak-value frequency set of the P-4 frame, because their power may be also very big) belongs to the sets $m^{p-2}$, $m^{p-3}$ simultaneously, and if yes, obtaining the phase and amplitude of the MDCT-MDST-domain complex signal of the $P^{th}$ frame at frequencies $m_i^{p-1}$, $m_i^{p-1}\pm1$ (the following calculation is made for all the three frequencies $m_i^{p-1}$, $m_i^{p-1}\pm1$ as long as one of the $m_i^{p-1}$, $m_i^{p-1}\pm1$ belongs to $m^{p-2}$, $m^{p-3}$ simultaneously) according to the following formulas (18)-(27):

$$\phi^{p-2}(m)=\angle v^{p-2}(m) \tag{18}$$

$$\phi^{p-3}(m)=\angle v^{p-3}(m) \tag{19}$$

$$\phi^{p-4}(m)=\angle v^{p-4}(m) \tag{20}$$

$$A^{p-2}(m)=|v^{p-2}(m)| \tag{21}$$

$$A^{p-3}(m)=|v^{p-3}(m)| \tag{22}$$

$$A^{p-4}(m)=|v^{p-4}(m)| \tag{23}$$

$$\hat{A}^{p}(m)=A^{p-2}(m) \tag{24}$$

wherein, $\phi$, A represents phase and amplitude respectively. For example, $\hat{\phi}^{p}(m)$ is the phase of the $P^{th}$ frame at the frequency m, $\hat{\phi}^{p-2}(m)$ is the phase of the $(P-2)^{th}$ frame at the frequency m, $\hat{\phi}^{p-3}(m)$ is the phase of the $(P-3)^{th}$ frame at the frequency m, $\hat{A}^{p}(m)$ is the amplitude of the $P^{th}$ frame at the frequency m, and $\hat{A}^{p-2}(m)$ is the amplitude of the $(P-2)^{th}$ frame at the frequency m, the rest is similar.

The least square method is used in the following to calculate a linear fit function of the phases of different frames at the same frequency $$\phi(m)=a_0+a_1x \tag{25}$$

wherein, x indicates a frame sequence number, $a_0$, $a_1$ indicate the coefficients of the linear fit function to be calculated. $a_0$, $a_1$ are obtained from the following system of formulas according to the method for measuring the fitting error using the least squares criterion $$\begin{bmatrix} 3 & \sum_{k=2}^{4} p-k \\ \sum_{k=2}^{4} p-k & \sum_{k=2}^{4} (p-k)^2 \end{bmatrix} \begin{bmatrix} a_0 \\ a_1 \end{bmatrix} = \begin{bmatrix} \sum_{k=2}^{4} \varphi^{p-k}(m) \\ \sum_{k=2}^{4} (p-k)\varphi^{p-k}(m) \end{bmatrix} \tag{26}$$

In other examples, the fitting error may also be measured and the fitting coefficients may be estimated using criterions other than the least squares criterion. The phase of the $P^{th}$ frame at the frequency m then may be estimated according to the obtained $a_0$, $a_1$ $$\hat{\phi}^{p}(m)=a_0+a_1p \tag{27}$$

accordingly, the MDCT coefficient of the $P^{th}$ frame at the frequency m obtained through compensation is $$\hat{c}^{p}(m)=\hat{A}^{p}(m)\cos[\hat{\phi}^{p}(m)] \tag{28}$$

If any frequency in all the $m_i^{p-4}$, $m_i^{p-4}\pm1$ belongs to the sets $m^{p-2}$, $m^{p-3}$ simultaneously, $S_C$ is used to indicate the set composed of all the frequencies compensated according to the above formulas (18)-(28), and half of the MDCT coefficient value of the last frame of the currently lost frame is taken as the MDCT coefficient value of the currently lost frame for the frequency which is outside the frequency set Sc in the frame.

If no frequency in all the $m_i^{p-4}$, $m_i^{p-4}\pm1$ belongs to the sets $m^{p-2}$, $m^{p-3}$ simultaneously, the MDCT coefficients are estimated for all the frequencies in the currently lost frame according to the formulas (18) to (28).

The operation of calculating the frequencies to be predicted may also not be performed, and MDCT coefficients are directly estimated according to the formulas (18) to (28) for all the frequencies in the currently lost frame.

Step 240, IMDCT transformation is performed for the MDCT coefficients of the currently lost frame at all the frequencies to obtain the time domain signal of the currently lost frame.

Figure 6:
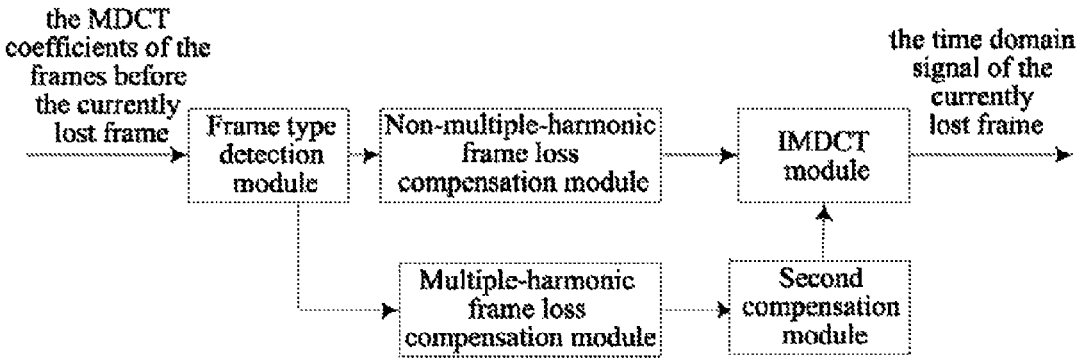
FIG. 6 is a block diagram of the compensator for audio frame loss in a MDCT domain in the invention.

The invention also provides a compensator for audio frame loss in a MDCT domain, the compensator comprising a frame type detection module, a non-multiple-harmonic frame loss compensation module, a multiple-harmonic frame loss compensation module, a second compensation module and an IMDCT module, as shown in FIG. 6, wherein:

the frame type detection module is configured to judge the type of the currently lost frame when detecting that the current frame is lost, and instruct the non-multiple-harmonic frame loss compensation module to compensate if the currently lost frame is a non-multiple-harmonic frame; instruct the multiple-harmonic frame loss compensation module to compensate if the currently lost frame is a multiple-harmonic frame; the specific method for judging the type of the currently lost frame is as previously described, and thus will not be described here;

the non-multiple-harmonic frame loss compensation module is configured to, for all frequencies in a frame, use the MDCT coefficient values of a plurality of frames before the currently lost frame to calculate the MDCT coefficient value of the currently lost frame, and transmit the MDCT coefficient to the IMDCT module;

the multiple-harmonic frame loss compensation module is configured to, when the currently lost frame is the $P^{th}$ frame, obtain a set of frequencies to be predicted, and for each frequency in the set of frequencies to be predicted, use the phases and amplitudes of a plurality of frames before $(P-1)^{th}$ frame in a MDCT-MDST domain to predict a phase and an amplitude of the $P^{th}$ frame in the MDCT-MDST domain, use the predicted phase and amplitude of the $P^{th}$ frame in the MDCT-MDST domain to obtain a MDCT coefficient of the $P^{th}$ frame at the each frequency, and transmit the MDCT coefficient to the second compensation module, wherein, the $(P-1)^{th}$ frame is a last frame of the $P^{th}$ frame;

the multiple-harmonic frame loss compensation module is configured to use MDCT-MDST-domain complex signals of the $(P-2)^{th}$ frame and the $(P-3)^{th}$ frame and a MDCT coefficient of the $(P-1)^{th}$ frame to obtain the set of frequencies to be predicted, and use phases and amplitudes of the $(P-2)^{th}$ frame and the $(P-3)^{th}$ frame in the MDCT-MDST domain to predict the phase and amplitude of the $P^{th}$ frame in the MDCT-MDST domain for each frequency in the frequency set.

When getting the set of frequencies to be predicted, the multiple-harmonic frame loss compensation module uses MDCT-MDST-domain complex signals and/or MDCT coefficients of a plurality of frames before the $P^{th}$ frame to obtain the set of frequencies to be predicted, or, put directly all frequencies in a frame in the frequency set.

The second compensation module is configured to, for a frequency outside the set of frequencies to be predicted in a frame, use MDCT coefficient values of a plurality of frames before the $P^{th}$ frame to calculate a MDCT coefficient of the $P^{th}$ frame at the frequency, transmit the MDCT coefficients of the $P^{th}$ frame at all frequencies to the IMDCT module; furthermore, the second compensation module uses half of a MDCT coefficient value of the $(P-1)^{th}$ frame as the MDCT coefficient value of the $P^{th}$ frame at a frequency outside the set of frequencies to be predicted.

The multiple-harmonic frame loss compensation module further comprises a frequency set generation unit and a coefficient generation unit, wherein, the frequency set generation unit is configured to generate the set $S_C$ of frequencies to be predicted;

the coefficient generation unit is configured to use phases and amplitudes of the L2 frames before the $(P-1)^{th}$ frame in the MDCT-MDST domain to predict a phase and an amplitude of each frequency belonging to the set $S_C$ of frequencies in the $P^{th}$ frame, use the predicted phase and amplitude of the $P^{th}$ frame in the MDCT-MDST domain to obtain the MDCT coefficient of the $P^{th}$ frame at each corresponding frequency, and transmit the MDCT coefficient to the second compensation module, wherein, L2>1.

The frequency set generation unit is configured to generate the set $S_C$ of frequencies to be predicted: setting a plurality of frames before the $P^{th}$ frame as L1 frames, calculating the power of each frequency in the L1 frames, and obtaining the sets of $S_1, \ldots, S_{L1}$ composed of peak-value frequencies in each frame in the L1 frames, the number of frequencies corresponding to each set being $N_1, \ldots, N_{L1}$ respectively;

selecting a set $S_i$ from the L1 sets $S_1, \ldots, S_{L1}$, judging whether any frequency in $m_j$, $m_j \pm 1, \ldots, m_j \pm k$ belongs simultaneously to all other peak-value frequency sets for each peak-value frequency $m_j$, $j=1 \ldots N_i$ in the $S_i$; if yes, putting all the $m_j$, $m_j \pm 1, \ldots, m_j \pm k$ in the frequency set $S_C$;

if no frequency in $m_j$, $m_j \pm 1, \ldots, m_j \pm k$ belongs to all other peak-value frequency sets simultaneously for each peak-value frequency $m_j$, $j=1 \ldots N_i$ in the $S_i$, putting all the frequencies in a frame in the frequency set $S_C$;

wherein, the k is a nonnegative integer. The peak-value frequency refers to a frequency whose power is bigger than powers on two adjacent frequencies thereof.

When $(P-1)^{th}$ frame is comprised in the L1 frames, the frequency set generation unit calculates the power of each frequency in the $(P-1)^{th}$ frame in the following way: $|\hat{v}^{p-1}(m)|^2=[c^{p-1}(m)]^2+[c^{p-1}(m+1)-c^{p-1}(m-1)]^2$, wherein $|\hat{v}^{p-1}(m)|^2$ is the power of the frequency m in the $(P-1)^{th}$ frame, $c^{p-1}(m)$ is the MDCT coefficient of the frequency m in the $(P-1)^{th}$ frame, $c^{p-1}(m+1)$ is the MDCT coefficient of the frequency m+1 in the $(P-1)^{th}$ frame, $c^{p-1}(m-1)$ is the MDCT coefficient of the frequency m−1 in the $(P-1)^{th}$ frame.

The coefficient generation unit further comprises a phase prediction sub-unit and an amplitude prediction sub-unit, wherein, the phase prediction sub-unit is configured to, for a frequency to be predicted, use the phases of L2 frames in the MDCT-MDST domain at the frequency to perform a linear extrapolation or a linear fit to obtain the phase of the $P^{th}$ frame in the MDCT-MDST domain at the frequency;

the amplitude prediction sub-unit is configured to obtain the amplitude of the $P^{th}$ frame in the MDCT-MDST domain at the frequency from an amplitude of one of the L2 frames in the MDCT-MDST domain at the frequency.

When L2=2, $t1^{th}$ frame, $t2^{th}$ frame are used to represent the two frames respectively, and the phase prediction sub-unit predicts the phase of the $P^{th}$ frame in the MDCT-MDST domain in the following way: for the frequency m to be predicted, $$\hat{\varphi}^{p}(m) = \varphi^{t1}(m) + \frac{p-t1}{t1-t2}[\varphi^{t1}(m) - \varphi^{t2}(m)],$$

the $\hat{\phi}^{p}(m)$ is a predicted value of the phase of the $P^{th}$ frame in the MDCT-MDST domain at the frequency m, the $\phi^{t1}(m)$ is the phase of the $t1^{th}$ frame in the MDCT-MDST domain at the frequency m, the $\phi^{t2}(m)$ is the phase of the $t2^{th}$ frame in the MDCT-MDST domain at the frequency m.

When L2>2, the phase prediction sub-unit predicts the phase of the $P^{th}$ frame in the MDCT-MDST domain in the following way: for a frequency to be predicted, perform a linear fit for the phases of the selected L2 frames in the MDCT-MDST domain at the frequency to obtain the phase of the $P^{th}$ frame in the MDCT-MDST domain at the frequency.

The IMDCT module is configured to perform an IMDCT for the MDCT coefficients of the $P^{th}$ frame at all frequencies to obtain the time domain signal of the $P^{th}$ frame.

Figure 7:
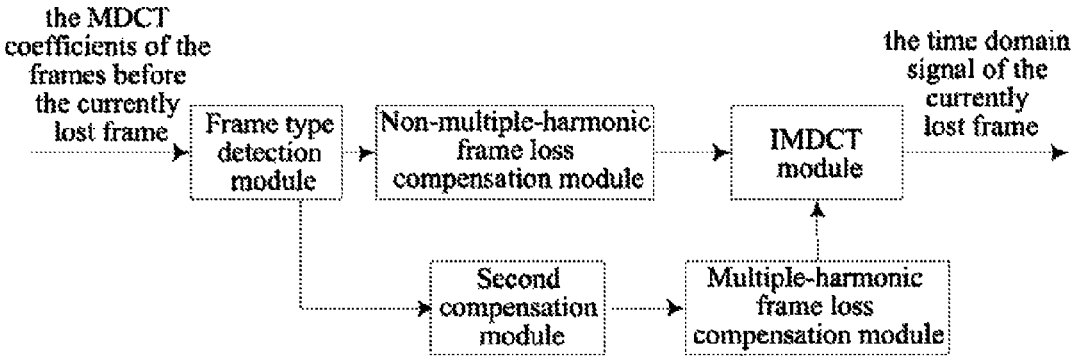
FIG. 7 is a block diagram of the compensator for audio frame loss in a MDCT domain in another example of the invention.

The compensator for audio frame loss in a MDCT domain shown in FIG. 6 may vary, as shown in FIG. 7, to comprise a frame type detection module, a non-multiple-harmonic frame loss compensation module, a multiple-harmonic frame loss compensation module, a second compensation module and an IMDCT module, the second compensation module being connected to the frame type detection module and the multiple-harmonic frame loss compensation module, the multiple-harmonic frame loss compensation module connected to the IMDCT module, wherein:

the second compensation module is configured to, for all frequencies in a frame, use MDCT coefficient values of a plurality of frames before the currently lost frame to calculate a MDCT coefficient value of the currently lost frame, and transmit the MDCT coefficient to the multiple-harmonic frame loss compensation module;

the multiple-harmonic frame loss compensation module is configured to obtain a set of frequencies to be predicted, and obtain a MDCT coefficient of the $P^{th}$ frame at each frequency in the set of frequencies to be predicted, the specific method being the same as the multiple-harmonic frame loss compensation module in the FIG. 6; for each frequency outside the set of frequencies to be predicted, use the MDCT coefficient obtained from the second compensation module as the MDCT coefficient of the $P^{th}$ frame at the frequency, and transmit the MDCT coefficients of the $P^{th}$ frame at all the frequencies to the IMDCT module.

The functions of other modules are similar to those of the modules in FIG. 6 and thus will not be repeated here.

Figure 8:
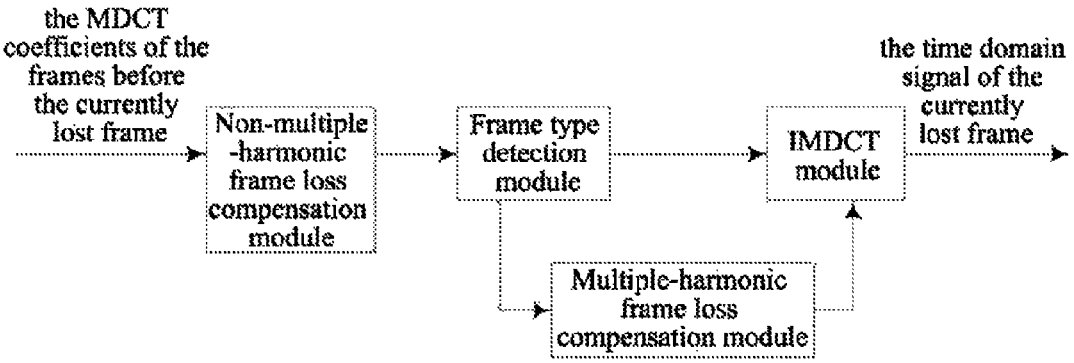
FIG. 8 is a block diagram of the compensator for audio frame loss in a MDCT domain in still another example of the invention.

As shown in FIG. 8, it is another block diagram of the compensator for audio frame loss in a MDCT domain in the invention, wherein, the compensator for audio frame loss in a MDCT domain comprises a non-multiple-harmonic frame loss compensation module, a frame type detection module, a multiple-harmonic frame loss compensation module, and an IMDCT module, wherein:

the non-multiple-harmonic frame loss compensation module is configured to, when detecting a lost frame, use the MDCT coefficient values of a plurality of frames before the currently lost frame to calculate the MDCT coefficient value of the currently lost frame for all frequencies in a frame, and transmit the MDCT coefficient to the frame type detection module;

the frame type detection module is configured to judge the type of the currently lost frame, and if the currently lost frame is a non-multiple-harmonic, transmit the MDCT coefficient received from the non-multiple-harmonic frame loss compensation module to the IMDCT module; if the currently lost frame is a multiple-harmonic, transmit the MDCT coefficient to the multiple-harmonic frame loss compensation module; the specific method for judging the type of the currently lost frame is the same as above mentioned and thus will not be repeated here.

The multiple-harmonic frame loss compensation module is configured to obtain a set of frequencies to be predicted, and obtain a MDCT coefficient of the $P^{th}$ frame at each frequency in the set of frequencies to be predicted, the specific method being the same as the multiple-harmonic frame loss compensation module in the FIG. 6; for each frequency outside the set of frequencies to be predicted, use the MDCT coefficient obtained from the frame type detection module as the MDCT coefficient of the $P^{th}$ frame at the frequency, and transmit the MDCT coefficients of the $P^{th}$ frame at all the frequencies to the IMDCT module;

the IMDCT module is configured to perform an IMDCT for the MDCT coefficients of the currently lost frame at all frequencies to obtain a time domain signal of the $P^{th}$ frame.

The compensation method and the compensator for audio frame loss disclosed in the invention may be applied to solve the problem of audio frame loss compensation in the real time two-way communication field, such as wireless, IP video conference and the real time broadcasting service field, such as IPTV, mobile streaming media, mobile TV and other fields to improve anti-error ability of a transmitted bit stream. The invention well avoids the reduction of speech quality brought by the packet loss during a voice audio network transmission through the compensation operation, improves the comfort of the voice audio quality after a packet loss, and obtains a great subjective sound effect.

INDUSTRIAL APPLICABILITY

Compared with the prior art, the compensator and compensation method for audio frame loss in a MDCT domain disclosed in the invention has the advantages of no delay, small amount of calculation and small volume of memory space, easy implementation and so on.

What is claimed is:

1. A compensation method for audio frame loss in a modified discrete cosine transform domain, the method comprising:

step a, when a frame currently lost is a $P^{th}$ frame, a decoder obtaining a set of frequencies to be predicted, and for each frequency in the set of frequencies to be predicted, the decoder using phases and amplitudes of a plurality of frames before a $(P-1)^{th}$ frame in a MDCT-MDST (modified discrete cosine transform-modified discrete sine transform) domain to predict a phase and an amplitude of the $P^{th}$ frame in the MDCT-MDST domain, the decoder using the predicted phase and amplitude of the $P^{th}$ frame in the MDCT-MDST domain to obtain a MDCT (modified discrete cosine transform) coefficient of the $P^{th}$ frame at said each frequency, wherein, the $(P-1)^{th}$ frame is a previous frame of the $P^{th}$ frame;

step b, for any frequency in a frame outside the set of frequencies to be predicted, the decoder using MDCT coefficients of a plurality of frames before the $P^{th}$ frame to calculate the MDCT coefficient of the $P^{th}$ frame at the frequency;

step c, the decoder performing an IMDCT (inverse modified discrete cosine transform) for the MDCT coefficients of the $P^{th}$ frame at all frequencies to obtain the time domain signal of the $P^{th}$ frame.

2. The method according to claim 1, wherein, before the step a, the method further comprises: when detecting that a current frame is lost, the decoder judging a type of the currently lost frame, and performing the step a if the currently lost frame is a multiple-harmonic frame.

3. The method according to claim 2, wherein, the step of judging the type of the currently lost frame comprises:

the decoder calculating a spectrum flatness of each of the K frames before the currently lost frame; if a number of frames whose spectrum flatness is smaller than a threshold value is smaller than or equal to $K_0$ in the K frames, the currently lost frame being a non-multiple-harmonic frame; if the number of frames whose spectrum flatness is smaller than the threshold value is greater than $K_0$, the currently lost frame being a multiple-harmonic frame; wherein, $K_0 <= K$, and $K_0$, K are natural numbers.

4. The method according to claim 1, wherein, the step of obtaining the set of frequencies to be predicted in the step a comprises:

the decoder using MDCT-MDST-domain complex signals and/or MDCT coefficients of a plurality of frames before the $P^{th}$ frame to obtain a set $S_C$ of frequencies to be predicted, or, directly putting all frequencies in a frame into the set $S_C$ of frequencies to be predicted.

5. The method according to claim 4, wherein, the step of using MDCT-MDST-domain complex signals and/or MDCT coefficients of a plurality of frames before the $P^{th}$ frame to obtain a set $S_C$ of frequencies to be predicted comprises:

the decoder setting said a plurality of frames before the $P^{th}$ frame as L1 frames, calculating a power of each frequency in the L1 frames, obtaining L1 sets of $S_1, \ldots, S_{L1}$ composed of peak-value frequencies in each frame in the L1 frames, and a number of frequencies in each set being $N_1, \ldots, N_{L1}$ respectively;

the decoder selecting a set $S_i$ from the L1 sets of $S_1, \ldots, S_{L1}$, for each peak-value frequency $m_j$, $j=1 \ldots N_i$ in the set $S_i$, judging whether there is any frequency belonging to all other peak-value frequency sets simultaneously among frequencies $m_j$, $m_j \pm 1, \ldots, m_j \pm k$, if there is any, the decoder putting all the frequencies $m_j$, $m_j \pm 1, \ldots, m_j \pm k$ into the frequency set $S_C$;

if there is no frequency belonging to all other peak-value frequency sets simultaneously, the decoder directly putting all the frequencies in a frame into the frequency set $S_C$;

wherein, said k is a nonnegative integer.

6. The method according to claim 5, wherein, said peak-value frequency refers to the frequency whose power is bigger than powers of two adjacent frequencies thereof.

7. The method according to claim 5, wherein, when the L1 frames comprise the $(P-1)^{th}$ frame, the power of each frequency in the $(P-1)^{th}$ frame is calculated in the following way: $|\hat{v}^{p-1}(m)|^2=[c^{p-1}(m)]^2 \quad [c^{p-1}(m+1)c^{p-1}+(m-1)]^2$, wherein, $|\hat{v}^{p-1}(m)|^2$ is the power of the frequency m in the $(P-1)^{th}$ frame, $c^{p-1}(m)$ is the MDCT coefficient of the frequency m in the $(P-1)^{th}$ frame, $c^{p-1}(m+1)$ is the MDCT coefficient of the frequency m+1 in the $(P-1)^{th}$ frame, $c^{p-1}(m-1)$ is the MDCT coefficient of the frequency m−1 in the $(P-1)^{th}$ frame.

8. The method according to claim 4, wherein, the step of using MDCT-MDST-domain complex signals and/or MDCT coefficients of a plurality of frames before the $P^{th}$ frame to obtain a set $S_C$ of frequencies to be predicted comprises: the decoder using MDCT-MDST-domain complex signals of the $(P-2)^{th}$ frame and the $(P-3)^{a^1}$ frame and MDCT coefficients of the $(P-1)^{th}$ frame to obtain the set $S_C$ of frequencies to be predicted;

the step of using phases and amplitudes of a plurality of frames before the $(P-1)^{th}$ frame in the MDCT-MDST (modified discrete cosine transform-modified discrete sine transform) domain to predict the phase and the amplitude of the $P^{th}$ frame in the MDCT-MDST domain comprises:

for each frequency in the frequency set $S_C$, the decoder using phases and amplitudes of the $(P-2)^{th}$ frame and the $(P-3)^{th}$ frame in the MDCT-MDST domain to predict the phase and the amplitude of the $P^{th}$ frame in the MDCT-MDST domain.

9. The method according to claim 1, wherein, the step of predicting the phase and the amplitude of the $P^{th}$ frame in the MDCT-MDST domain in the step a comprises: for each frequency to be predicted, the decoder using phases of L2 frames before the $(P-1)^{th}$ frame at the frequency in the MDCT-MDST domain to perform linear extrapolation or linear fit to obtain the phase of the $P^{th}$ frame at the frequency in the MDCT-MDST domain; and the decoder obtaining the amplitude of the $P^{th}$ frame at the frequency in the MDCT-MDST domain according to the amplitude of one of the L2 frames at the frequency in the MDCT-MDST domain, wherein, L2>1.

10. The method according to claim 9, wherein, when L2=2, the step of using phases of L2 frames before the $(P-1)^{th}$ frame at the frequency in the MDCT-MDST domain to perform linear extrapolation or linear fit to obtain the phase of the $P^{th}$ frame at the frequency in the MDCT-MDST domain comprises:

the decoder obtaining the phase $\phi^p(m)$ of the Pth frame in the MDCT-MDST domain according to the following formula:

$$\hat{\varphi}^p(m) = \varphi^{t1}(m) + \frac{p - t1}{t1 - t2}[\varphi^{t1}(m) - \varphi^{t2}(m)],$$

wherein, a $t1^{th}$ frame and a $t2^{th}$ frame represent two frames before the $(P-1)^{th}$ frame, m is a frequency to be predicted, $\phi^{t1}(m)$ is a phase of the $t1^{th}$ frame at the frequency m in the MDCT-MDST domain, and $\phi^{t2}(m)$ is a phase of the $t2^{th}$ frame at the frequency m in the MDCT-MDST domain.

11. The method according to claim 9, wherein, when L2>2, the step of using phases of L2 frames before the $(P-1)^{th}$ frame at the frequency in the MDCT-MDST domain to perform linear extrapolation or linear fit to obtain the phase of the $P^{th}$ frame at the frequency in the MDCT-MDST domain comprises:

for each frequency to be predicted, the decoder performing a linear fit with phases of the L2 frames before the $(P-1)^{th}$ frame at the frequency in the MDCT-MDST domain to obtain the phase of the $P^{th}$ frame at the frequency in the MDCT-MDST domain.

12. The method according to claim 1, wherein, the step of using MDCT coefficients of a plurality of frames before the $P^{th}$ frame to calculate the MDCT coefficient of the $P^{th}$ frame at the frequency comprises:

the decoder using half of the MDCT coefficient of the $(P-1)^{th}$ frame as the MDCT coefficient of the $P^{th}$ frame.

13. A compensator for audio frame loss in a modified discrete cosine transform domain, comprising a multiple-harmonic frame loss compensation module, a second compensation module and an IMDCT module, wherein:

the multiple-harmonic frame loss compensation module is configured to, when a frame currently lost is a $P^{th}$ frame, obtain a set of frequencies to be predicted, and for each frequency in the set of frequencies to be predicted, use phases and amplitudes of a plurality of frames before a $(P-1)^{th}$ frame in a MDCT-MDST domain to predict a phase and an amplitude of the $P^{th}$ frame in the MDCT-MDST domain, use the predicted phase and amplitude of the $P^{th}$ frame in the MDCT-MDST domain to obtain a MDCT coefficient of the $P^{th}$ frame at said each frequency, and transmit the MDCT coefficient to the second compensation module, wherein, the $(P-1)^{th}$ frame is a frame before the $P^{th}$ frame;

the second compensation module is configured to, for any frequency outside the set of frequencies to be predicted in a frame, use MDCT coefficients of a plurality of frames before the $P^{th}$ frame to calculate the MDCT coefficient of the $P^{th}$ frame at the frequency, and transmit the MDCT coefficients of the $P^{th}$ frame at all frequencies to the IMDCT module;

the IMDCT module is configured to perform an IMDCT for the MDCT coefficients of the $P^{th}$ frame at all frequencies to get a time domain signal of the $P^{th}$ frame.

14. The compensator for frame loss according to claim 13, further comprising a frame type detection module which is configured to, when detecting that a frame is lost, judge a type of the currently lost frame, and instruct the multiple-harmonic frame loss compensation module to make compensation if the currently lost frame is a multiple-harmonic frame.

15. The compensator for frame loss according to claim 13, wherein, the multiple-harmonic frame loss compensation module comprises a frequency set generation unit, and the multiple-harmonic frame loss compensation module is configured to, through the frequency set generation unit, use MDCT-MDST-domain complex signals and/or MDCT coefficients of a plurality of frames before the $P^{th}$ frame to obtain a set $S_C$ of frequencies to be predicted, or, directly put all frequencies in a frame into the set $S_C$ of frequencies to be predicted.

16. The compensator for frame loss according to claim 13, wherein, the multiple-harmonic frame loss compensation module further comprises a coefficient generation unit, and the multiple-harmonic frame loss compensation module is configured to, through the coefficient generation unit, to use phases and amplitudes of the L2 frames before the $(P-1)^{th}$ frame in the MDCT-MDST domain to predict a phase and an amplitude of each frequency belonging to the set of frequencies to be predicted in the $P^{th}$ frame, use the predicted phase and amplitude of the $P^{th}$ frame to obtain the MDCT coefficient of the $P^{th}$ frame corresponding to the each frequency, and transmit the MDCT coefficient to the second compensation module, wherein, L2>1;

the coefficient generation unit comprises a phase prediction sub-unit and an amplitude prediction sub-unit, wherein:

the phase prediction sub-unit is configured to, for a frequency to be predicted, use phases of L2 frames at the frequency in the MDCT-MDST domain to perform linear extrapolation or linear fit to obtain the phase of the $P^{th}$ frame at the frequency in the MDCT-MDST domain;

the amplitude prediction sub-unit is configured to obtain the amplitude of the $P^{th}$ frame at the frequency in the MDCT-MDST domain from the amplitude of one of the L2 frames at the frequency in the MDCT-MDST domain.

17. The compensator for frame loss according to claim 16, wherein, the phase prediction sub-unit is configured to, when L2=2, predict the phase of the $P^{th}$ frame in the MDCT-MDST domain according to a following formula:

$$\hat{\varphi}^{p}(m) = \varphi^{t1}(m) + \frac{p - t1}{t1 - t2}[\varphi^{t1}(m) - \varphi^{t2}(m)],$$

wherein, a $t1^{th}$ frame and a $t2^{th}$ frame represent two frames before the $(P-1)^{th}$ frame, m is a frequency to be predicted, $\hat{\varphi}^{p}(m)$ is a predicted value of the phase of the $P^{th}$ frame at the frequency m in the MDCT-MDST domain, $^{t1}(m)$ is a phase of the $t1^{th}$ frame at the frequency m in the MDCT-MDST domain, and $\varphi^{t2}(m)$ is a phase of the $t2^{th}$ frame at the frequency m in the MDCT-MDST domain.

18. The compensator for frame loss according to claim 15, wherein, the multiple-harmonic frame loss compensation module is configured to use MDCT-MDST-domain complex signals of the $(P-2)^{th}$ frame and the $(P-3)^{th}$ frame and MDCT coefficients of the $(P-1)^{th}$ frame to obtain the set of frequencies to be predicted, and use phases and amplitudes of the $(P-2)^{th}$ frame and the $(P-3)^{th}$ frame in the MDCT-MDST domain to predict the phase and the amplitude of the $P^{th}$ frame in the MDCT-MDST domain for each frequency in the frequency set.

19. The compensator for frame loss according to claim 13, wherein, the second compensation module is configured to use half of the MDCT coefficient value of the $(P-1)^{th}$ frame as the MDCT coefficient value of the $P^{th}$ frame at a frequency outside the set of frequencies to be predicted.

* * * * *